US006431380B1

(12) United States Patent
Branson

(10) Patent No.: US 6,431,380 B1
(45) Date of Patent: Aug. 13, 2002

(54) CHILD-RESISTANT FLIP TOP CLOSURE

(75) Inventor: Mark K. Branson, Newburgh, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/692,787

(22) Filed: Oct. 20, 2000

Related U.S. Application Data

(60) Provisional application No. 60/160,665, filed on Oct. 21, 1999.

(51) Int. Cl.[7] ..... B65D 55/02

(52) U.S. Cl. ..... 215/206; 215/224; 215/225; 215/235; 215/253

(58) Field of Search ..... 215/206, 209, 215/224, 225, 235, 237, 253, 318, 321, 303, 304, 305

(56) References Cited

U.S. PATENT DOCUMENTS

| | | | | | |
|---|---|---|---|---|---|
| 3,710,971 | A | * | 1/1973 | Jones | 215/206 |
| 3,759,411 | A | * | 9/1973 | Horvath | 215/206 |
| 3,904,063 | A | * | 9/1975 | Hauser | 215/318 |
| 3,907,145 | A | * | 9/1975 | Horvath | 215/206 |
| 3,955,696 | A | * | 5/1976 | Finke | 215/224 |
| 3,980,194 | A | * | 9/1976 | Costa | 215/206 |
| 4,043,475 | A | | 8/1977 | Wheeler | |
| 4,335,823 | A | * | 6/1982 | Montgomery et al. | 215/206 |
| 4,356,924 | A | | 11/1982 | Walter | |
| 4,361,244 | A | | 11/1982 | Walter | |
| 4,424,910 | A | | 1/1984 | Heinol | |
| 4,444,326 | A | | 4/1984 | Musel | |
| 4,531,650 | A | | 7/1985 | Friendship | |
| 4,573,599 | A | | 3/1986 | Fillmore | |
| 4,629,081 | A | | 12/1986 | McLaren | |
| 4,694,968 | A | * | 9/1987 | Proctor et al. | 215/224 |
| 4,718,567 | A | | 1/1988 | La Vange | |
| 4,759,455 | A | | 7/1988 | Wilson | |
| 4,782,964 | A | | 11/1988 | Poore et al. | |
| 4,821,898 | A | | 4/1989 | Smalley | |
| 4,892,208 | A | | 1/1990 | Sledge | |
| 4,919,286 | A | | 4/1990 | Agbay, Sr. | |
| 4,941,580 | A | | 7/1990 | Julian | |
| 5,040,691 | A | | 8/1991 | Hayes et al. | |
| 5,065,876 | A | | 11/1991 | Joyce | |
| 5,083,671 | A | | 1/1992 | Hayes | |
| 5,092,493 | A | | 3/1992 | Pehr | |
| 5,097,974 | A | | 3/1992 | Rozenberg | |
| 5,180,072 | A | | 1/1993 | Oehlert | |
| 5,312,010 | A | | 5/1994 | Johnson | |
| 5,398,829 | A | | 3/1995 | Stubbs | |
| 5,464,112 | A | | 11/1995 | Guillot | |
| 5,593,054 | A | | 1/1997 | Glynn | |
| 5,635,756 | A | | 6/1997 | Johnson | |
| 5,702,013 | A | | 12/1997 | Freed | |
| 5,826,738 | A | * | 10/1998 | Minh | 215/206 |
| 5,829,609 | A | * | 11/1998 | Beck | 215/206 |
| 5,938,054 | A | | 8/1999 | Loader | |

* cited by examiner

*Primary Examiner*—Nathan J. Newhouse
(74) *Attorney, Agent, or Firm*—John F. Salazar; James Daly, IV

(57) ABSTRACT

A closure is described wherein a flip top is provided with a child-resistant opening mechanism. The flip top closure is attached to a neck finish, fitment or other container spout and includes a flip top that is hingedly attached to a depending sidewall. The child-resistant mechanism includes a retention tab that engages a retention bead when the flip top is closed, but allows the top to be opened by the alignment of the retention tab with a retention lug, located on the neck finish or fitment, over which the retention tab may slide when upward force is applied to a thumb tab attached to the top. The interaction of the retention tab and the retention lug when the flip top is closed prevents the closure from being automatically aligned for opening, after the closure is closed.

19 Claims, 10 Drawing Sheets

CHILD-RESISTANT FLIP TOP CLOSURE

This application claims the benefit of United States Provisional Application No. 60/160,665 filed Oct. 21, 1999.

BACKGROUND OF THE INVENTION

1. Field of the Invention

The present invention relates to flip top closures and in particular to flip top closures having child-resistant opening mechanisms. More particularly, the present invention relates to a flip top closure having a child-resistant mechanism in which the top is automatically aligned in a nonopening position when closed.

2. Discussion of the Prior Art

Child-resistant closures that require proper alignment for opening are well known in the art. Such closures often have components, such as retaining beads and lugs, which maintain the closure in a closed position when it is not properly aligned to be opened. Such closures often have either one or a limited number of positions in which the parts must be aligned in order to be opened. The opening position for such closures is often referred to as the firing position, and in some cases, closures must be in the firing position in order to be closed, as well as to be opened. Since most such child-resistant closures either require or allow the closure to be closed while aligned in the firing position, after such closures are closed by the user, they may remain aligned to be opened, thereby defeating the intended purpose of the child-resistant features therein. Therefore, it is desirable to provide a child-resistant closure which maybe closed regardless of its alignment and is automatically displaced out of the firing position when the user closes it, thereby reactivating the child-resistant features thereof.

SUMMARY OF THE INVENTION

It is an object of the present invention to provide a closure with a child-resistant opening mechanism.

It is another object of the present invention to provide a closure having a child-resistant feature that automatically displaces the closure from the opening or firing position when closed by a user.

The apparatus of the present invention relates to a flip top closure having a child-resistant mechanism which may be utilized in conjunction with a container finish such as a neck, fitment or other finish which is incorporated as part of or attached to a container. The flip top closure of the present invention provides a child-resistant opening mechanism that prevents opening when not properly aligned and also displaces the closure from the firing position as it is closed. This closure may be used with a variety of containers, such as tubes and bottles.

More particularly, the apparatus of the present invention a flip top closure including a cap with a top wall and a downwardly depending sidewall which is attached to an outer ring via a small hinge line which extends along a short length of the periphery of the ring and the depending sidewall. The outer ring engages a rib, or similar structure, located either on the base portion of the closure or the container finish, thereby allowing the ring to rotate about the container finish. The hinge allows the top to rotate about the hinge to 90° and beyond. The base portion of the flip top closure maybe threadably attached to the neck finish, or fitment, snap fitted thereon or formed integrally therewith.

The hinge allows opening of the container by allowing the flip top to rotate about the hinge line. The flip top may be opened by upward pressure applied to a thumb tab located thereon.

The child-resistant mechanism of the present invention includes a rotational follower and opening follower which may be aligned on a retention tab mounted along an inner edge of the downwardly depending sidewall of the flip top or cap and at a 180° angle in relation to the location of the hinge. The mechanism also includes a rotational cam and opening cam which may be formed within a retention lug located on the container finish adjacent a retention bead. The opening cam and opening follower interact to allow the cap to be opened when the closure is in the firing position.

The rotational cam and rotational follower may interact to displace the closure out of the firing position as it is being closed. The rotational cam serves as a means for biasing the rotational follower, thereby biasing the entire cap. The firing or opening position refers to the rotational alignment of the flip top relative to the container finish, such that the opening cam is in a position to engage the opening follower when an opening force is applied to the cap. If the closure is aligned in the firing position, with the retention tab aligned with the retention lug, then the retention lug biases the retention tab either to the left or to the right of the lug, due to the engagement of the rotational cam and rotational follower, as the top is being closed. As downward force is exerted on the top as it is being closed, the engagement of the retention tab with the retention lug forces the flip top and outer ring to rotate so that the retention tab is positioned either to the left or to the right of the retention lug. The retention tab then snaps under and is retained by a retention bead located on the neck or container finish. The retention bead projects outwardly from the neck finish or fitment and may extend around the circumference of the neck finish or fitment being interrupted only by the retention lug. When the flip top closure is closed, the retention bead, in combination with the retention tab, prevents opening of the top when the retention tab and the retention lug are not aligned in the firing position.

In order to open the flip top, it must be rotated so that the retention tab and the retention lug are aligned with each other in the firing position. This alignment may be indicated by two arrows, an outer ring or first arrow, located on the outer ring, which is aligned with the retention tab and a neck finish or second arrow, located on the neck finish or fitment, which is aligned with the retention bead. The flip top is rotatable about a vertical longitudinal axis. The outer ring arrow rotates with the top and the retention tab so as to indicate the position of the retention tab. Once the retention tab and the retention lug are aligned in the firing position, a sufficient upward force applied to the flip top will result in opening. As force is applied to an optional thumb tab located on the cap, the retention tab will slide up over the retention lug, thereby allowing the closure to be opened.

Depending from the top wall of the flip top is a seal or gasket of a diameter sufficient to compress against an interior sidewall of the neck finish so as to provide a seal between the flip top and the neck finish or the fitment. This seal will prevent leakage of the package contents. An annular bead formed in the downwardly depending sidewall of the top wall maybe employed to help secure the gasket in place.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
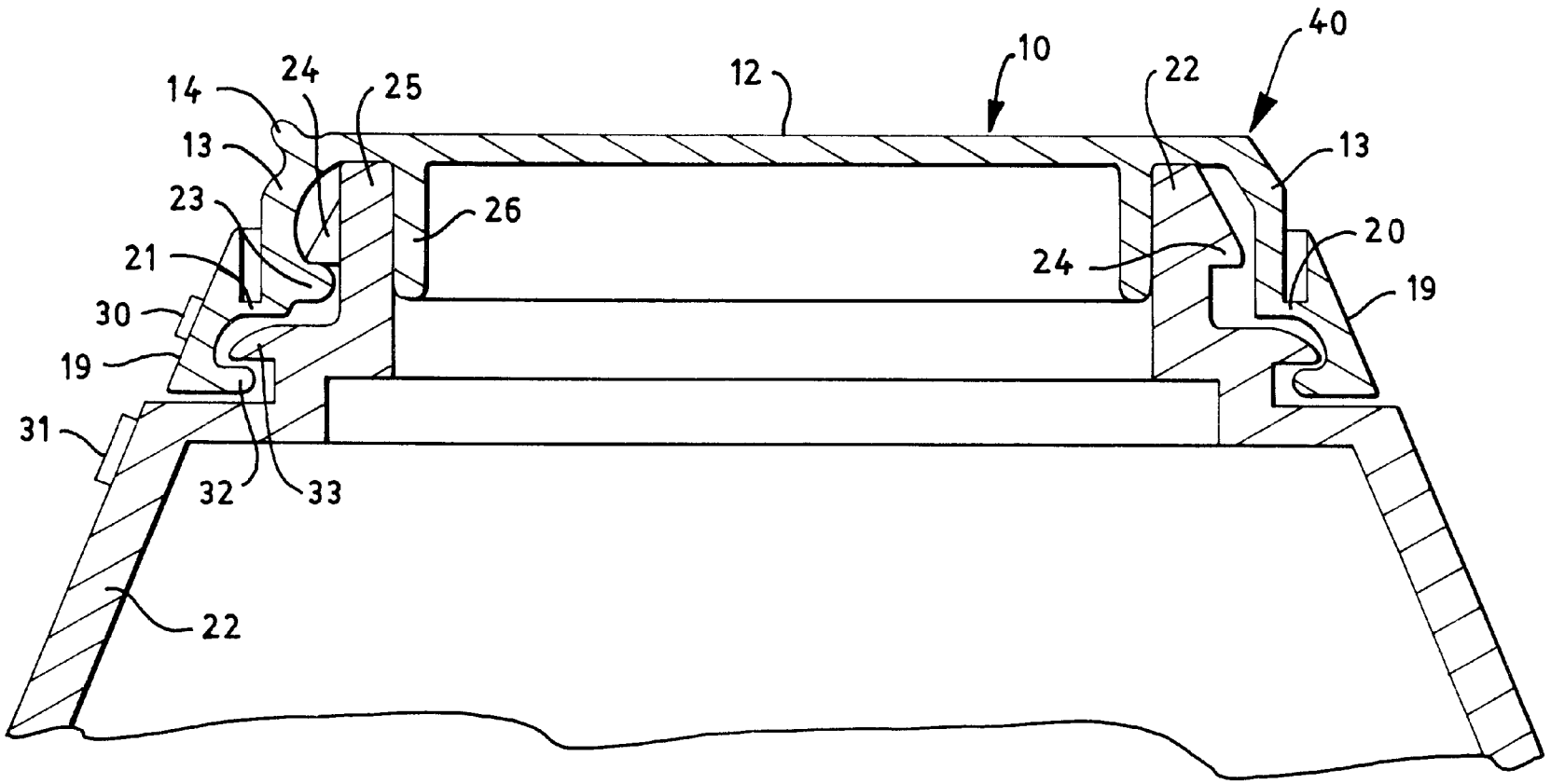
FIG. 1 is a perspective view of a preferred embodiment of the closure of the present invention.

As shown in FIGS. 1–5, a closure 10 of the present invention may be used with containers such as bottles and tubes. FIG. 1 shows a flip top closure 10 including a flip top 40 and a container or neck finish 22 having an opening 15. Flip top 40 includes a top or cap 12, a hinge 20, shown in FIG. 1*a*, and an outer ring 19. Cap or top 12 has a top wall 11 and a side wall 13 depending therefrom, as well as a thumb tab 14 projecting therefrom. Thumb tab 14 may also be disposed within top 12. Outer ring 19 is movably attached to container or neck finish 22. Outer ring 19 may include a first arrow or indicator 30 which maybe aligned with opening follower 48 or retention tab 23, shown in FIG. 1*a*, which projects from side wall 13. A second arrow or indicator 31 maybe disposed on the base portion of the closure 10 or the container finish 22. When the closure 10 is aligned in the opening or firing position, which will be discussed herein below, the first arrow 30 and second arrow 31 are aligned, as shown in FIG. 1, thereby indicating the position of the closure 10. When the closure 10 is not in the open or firing position, the first arrow 30 and the second arrow 31 are not aligned, as shown in FIG. 2*a*.

Figure 1A:
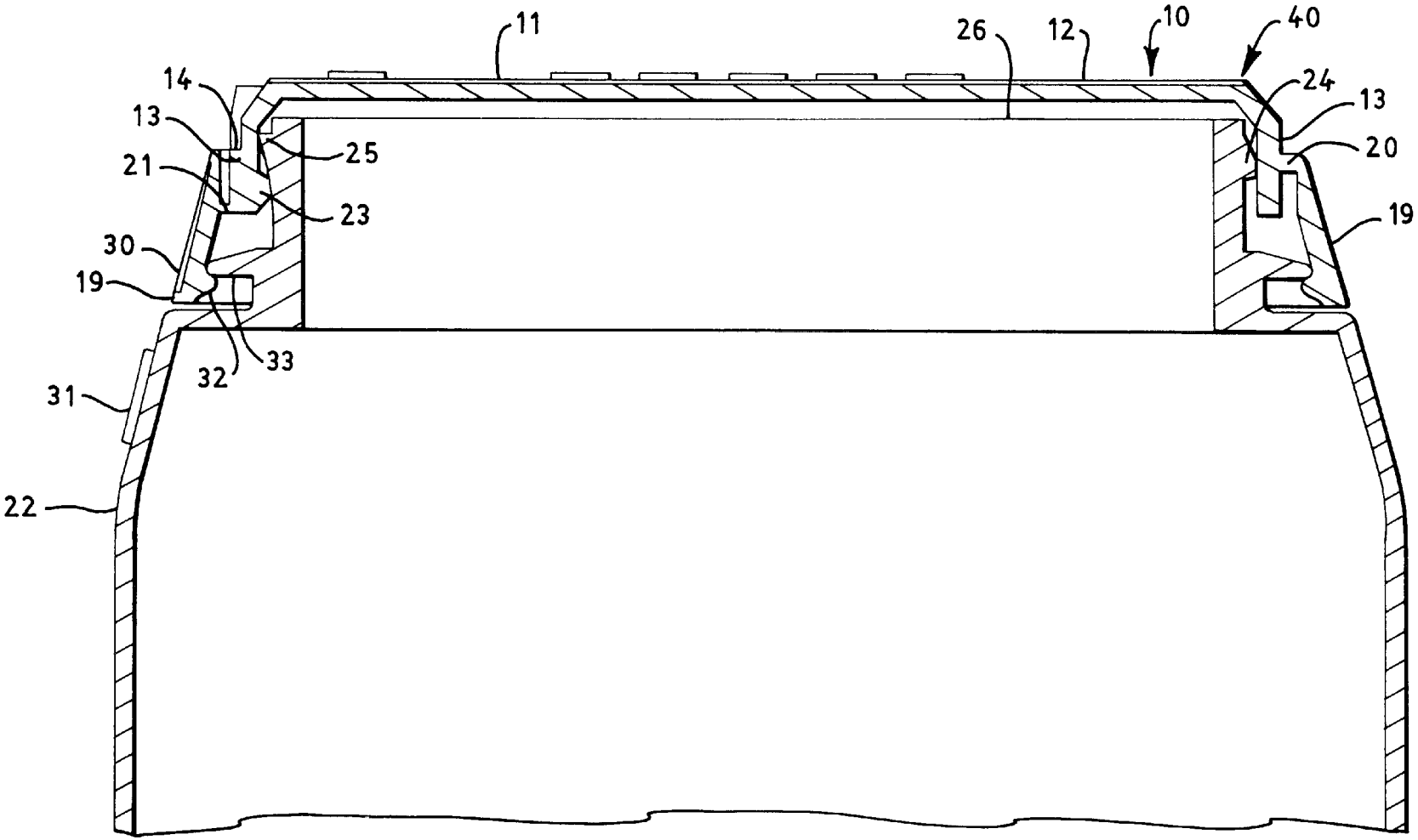
FIG. 1*a* is a sectional view of the closure of FIG. 1 taken along line A—A.

FIGS. 1*a* shows the top or cap 12 attached to a hinge 20 which rotatably affixes the top 12 to outer ring 19. Depending below the top wall 11 of top 12 is a seal 26. This seal 26 of the top 12 rests firmly against the neck finish 22 thereby forming a seal between the neck finish 22 and the flip top 12.

As shown in FIG. 1*a*, rotational cam 37 and an opening cam 38 may be formed within a retention lug 25 which projects from container finish 22. Alternatively, rotational cam 37 and opening cam 38 may be formed separately from each other. Likewise, rotational follower 47 and opening follower 48 maybe formed within retention tab 23, which projects from side wall 13 of cap 40. Alternatively, rotational follower 47 and opening follower 48 may be formed independently of each other. In each case, rotational cam 37 and opening cam 38, as well as rotational follower 47 and opening follower 48, are functionally aligned with each other. More particularly, the rotational elements are functionally aligned with their corresponding opening elements, such that closure 10 is automatically displaced from the firing position as the closure 10 is closed. Rotational cam 37 and opening cam 38 are so functionally aligned that, after rotational cam 37 has engaged rotational follower 47 so as to rotationally bias cap 12, opening cam 38 is then not aligned with opening follower 48. Retention bead 24 extends around a portion of the circumference of neck finish 22, and may be interrupted by retention lug 25. In one embodiment, retention bead 24, in combination with retention lug 25, circumscribes the container finish 22. First arrow or indicator 30, located on outer ring 19 is shown aligned with second arrow or indicator 31, which is located on neck finish 22. First or outer ring arrow 30 may also be moved out of alignment with second arrow 31 by rotating flip top 40. First arrow 30 may also be located on the outer wall of top 12 or another position which both aligns it with retention tab 23 and allows it to be visible from outside of the container.

FIG. 1*a* also shows outer ring locking bead 32 which projects inwardly from outer ring 19. Outer ring locking bead 32 engages neck finish rib 33, which projects outwardly from neck finish 22. This engagement of outer ring locking bead 32 and neck finish rib 33 secures the flip top 40 to neck finish 22, while also allowing the flip top 40 to be rotated about neck finish 22.

Thumb tab 14 is shown in FIGS. 1 and 1*a* affixed to top 12 and aligned over retention tab 23.

Upward force may be applied to thumb tab 14 in order to open top 12 and rotate the top 12 on hinge 20. Temporary attachment bridge 21 is shown in FIG. 1*a* in alignment with outer ring arrow 30 and thumb tab 14. Temporary attachment bridge 21 may be broken prior to or during the first opening of the flip top closure 40. Temporary attachment bridge 21 secures the top 12 in place during shipping and handling prior to the first opening.

Figure 2:
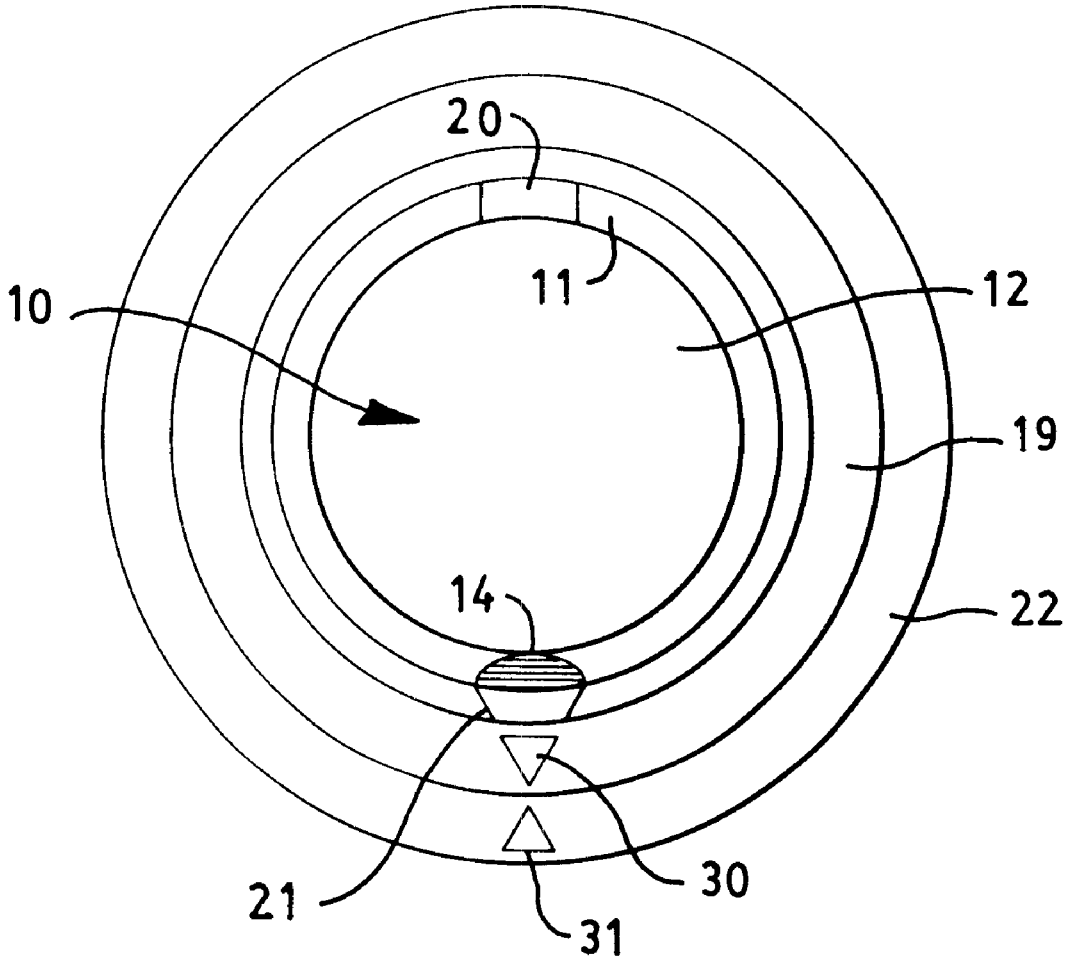
FIG. 2 is atop view of the closure of FIG. 1.
Figure 2A:
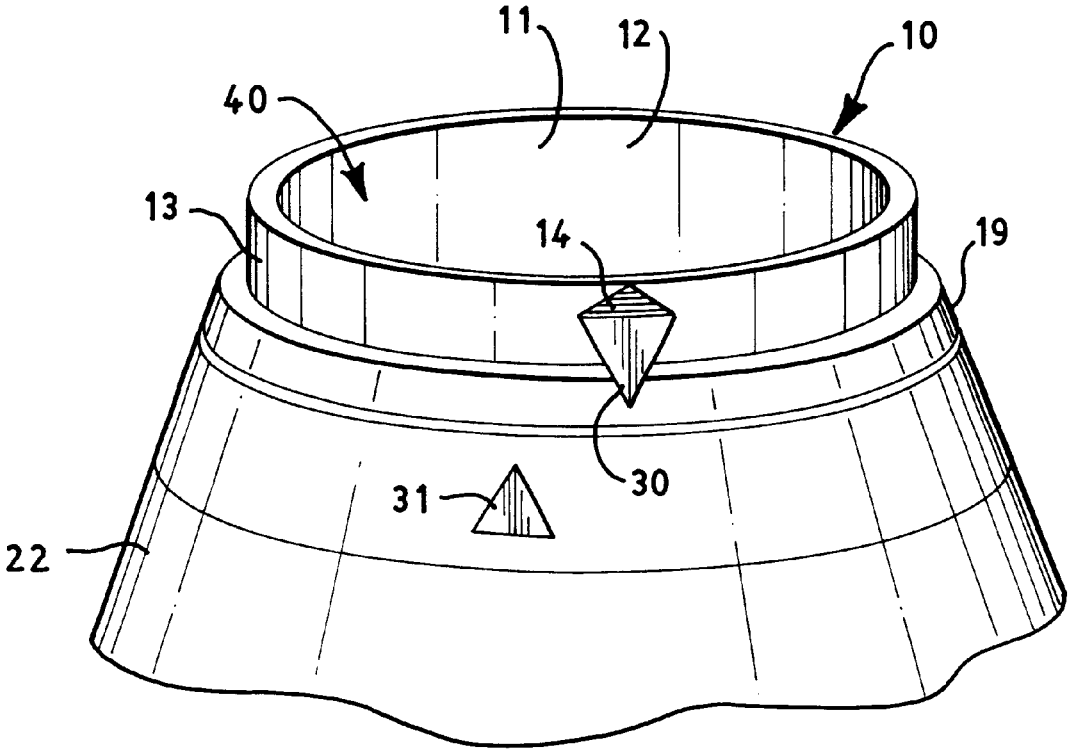
FIG. 2*a* is a perspective view of the closure of the present invention in which the flip top is not in the firing position.

FIG. 2 shows a top view of the closure 10 prior to the first opening, as was shown in FIG. 1. First indicator 30, located on outer ring 19, is aligned with second indicator 31, located on neck finish 22. Hinge 20 attaches top 12 to outer ring 19. Temporary attachment bridge 21, shown aligned below thumb tab 14, extends over a small portion of the circumference of outer ring 19 and also attaches top 12 to outer ring 19.

Figure 3:
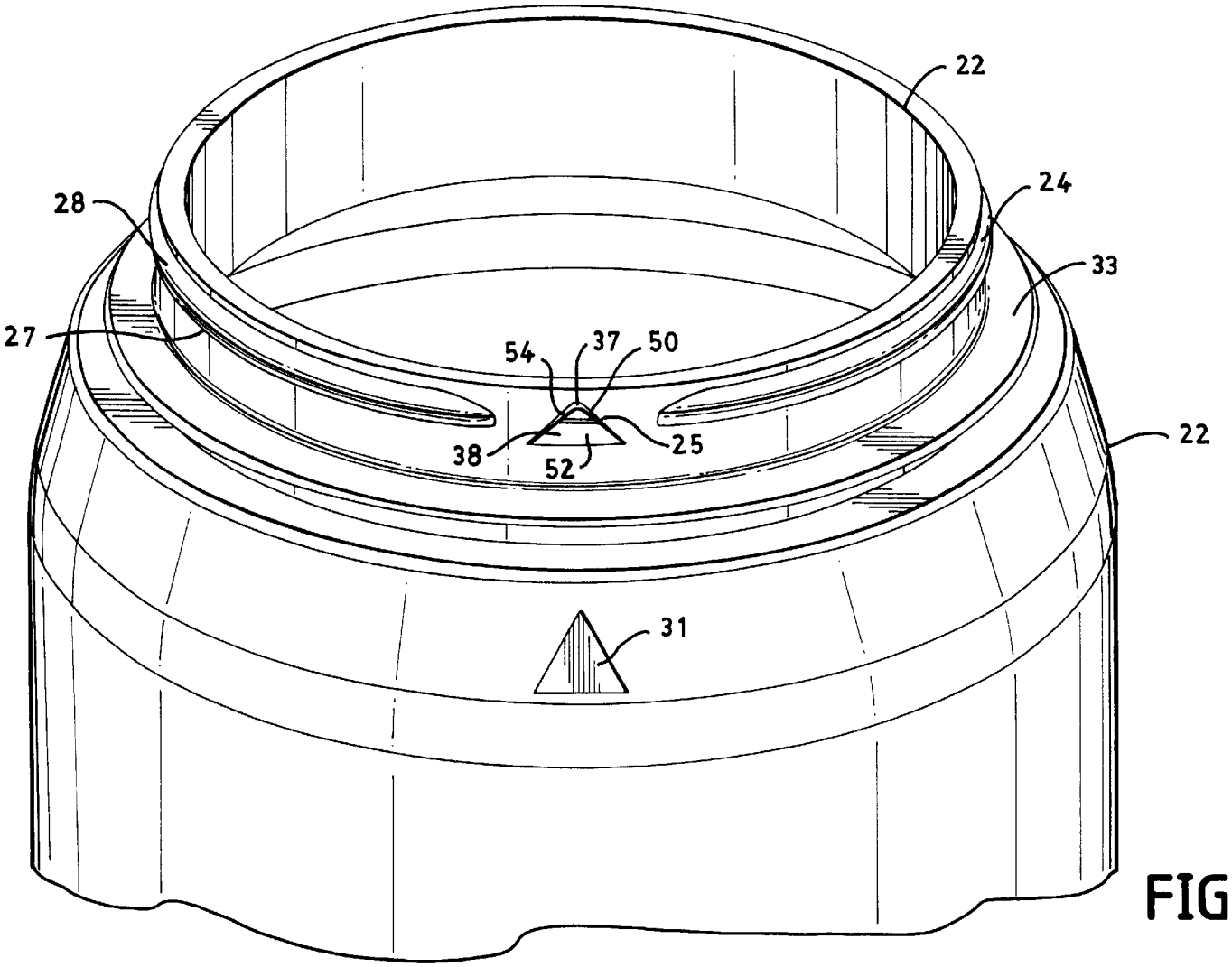
FIG. 3 is a perspective view of a neck finish or fitment of the present invention.
Figure 3A:
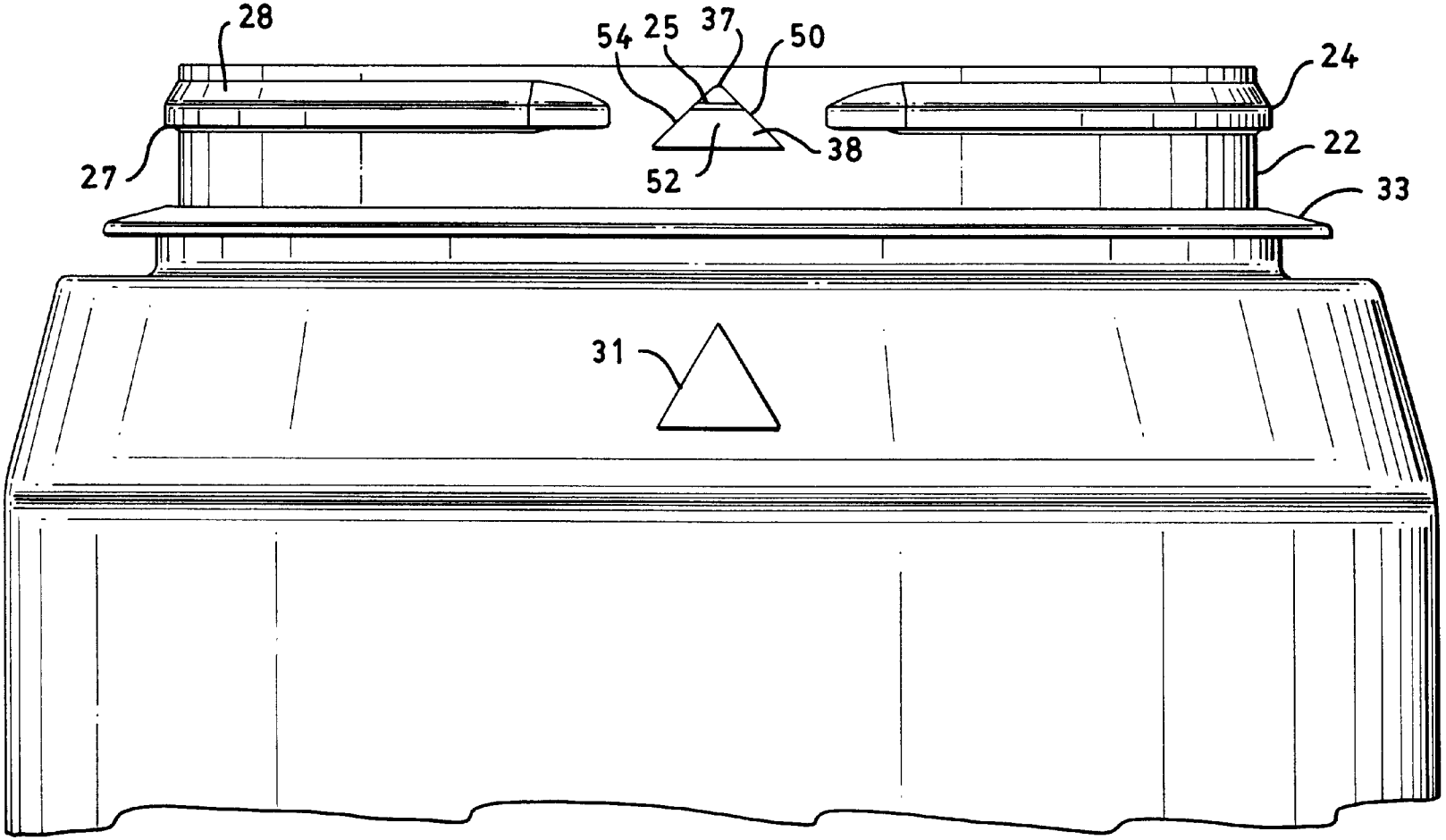
FIG. 3*a* is a front view of the neck finish of FIG. 3.
Figure 3B:
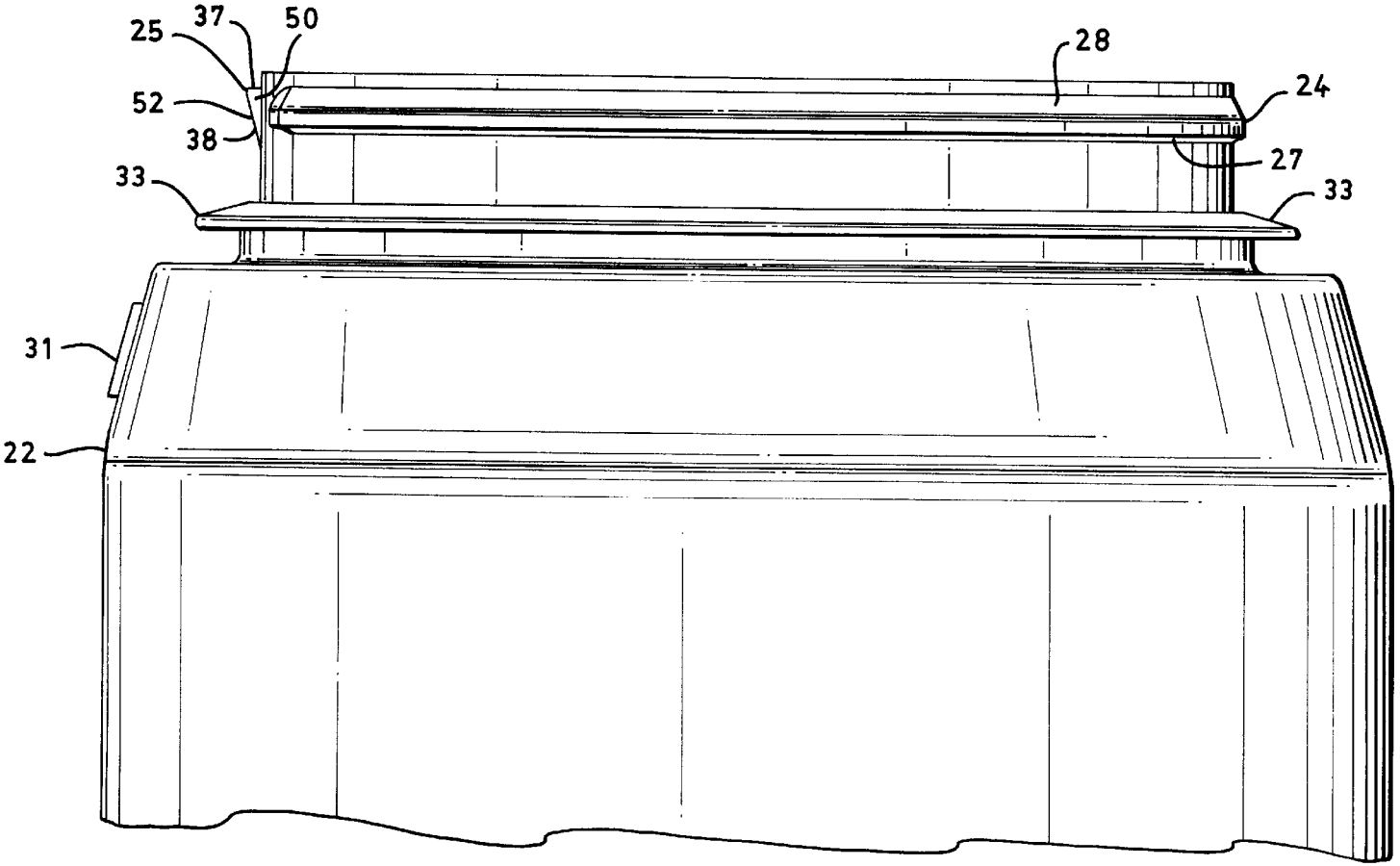
FIG. 3*b* is a side view of the neck finish of FIG. 3.

FIGS. 3–3*b* shows the neck or container finish 22 of the present invention in the absence of flip top 40. Retention bead 24 projects outwardly from and extends around the circumference of neck finish 22. Retention lug 25, including rotational cam 37 and opening cam 38, projects from neck finish 22. In this embodiment, rotational cam 37 includes two sloped surfaces 50 and 54 which slope down either side of retention lug 25. Rotational cam 37 includes at least one surface that serves as a biasing surface for rotational follower 47. Retention lug 25 also includes opening cam 38 which includes a first lower surface 52. Retention bead 24 includes at least one second sloped upper surface 28 and a second lower surface 27. When the closure 10 is being closed, retention tab 23 may be brought down over the top of retention lug 25, when they are in alignment, thereby contacting a second lower surface 51 of retention tab 23, shown in FIG. 5, with either of the two first upper sloped surfaces 50 and 54. First sloped upper surfaces 50 and 54 prevent retention tab 23 from sliding down directly over retention lug 25. Rather, the first sloped upper surfaces 50 and 54 cause retention tab 23 to slide down to one of the sides of retention lug 25. Retention tab 23 then will slide over the second sloped upper surface 28 of retention bead 24 and engage retention bead 24 at the second lower surface 27, thereby preventing top 12 from being opened while retention tab 23 is so engaged. Retention tab 23 may rotate about the entire length of retention bead 24 and remain engaged thereto.

Figure 4:
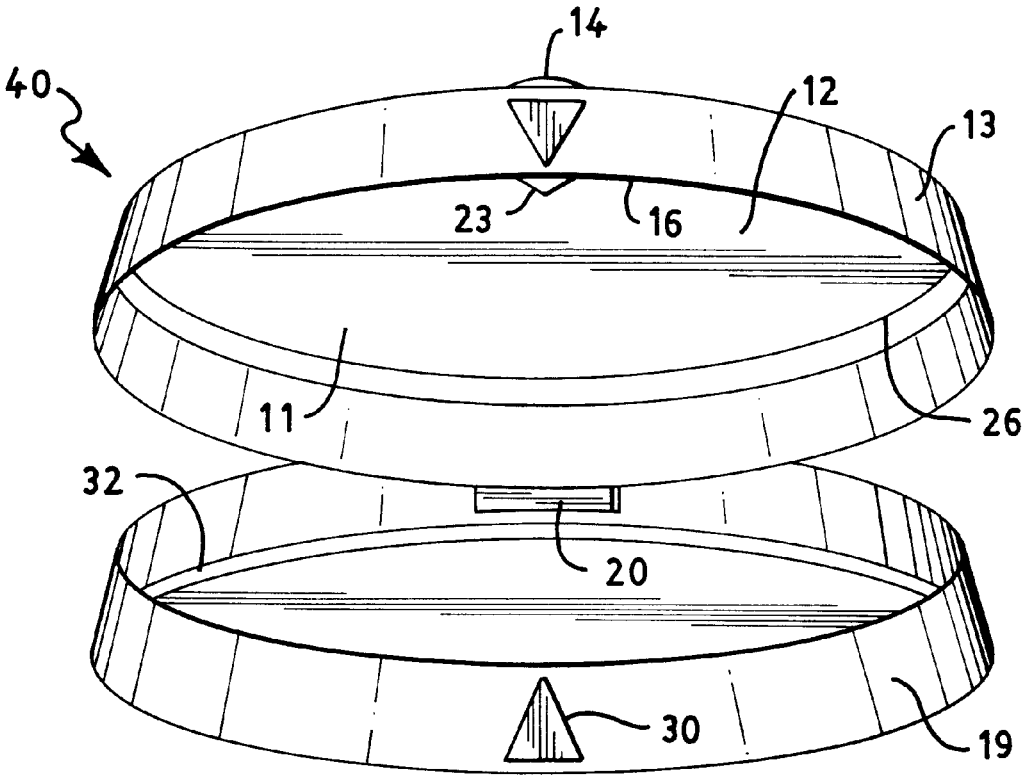
FIG. 4 is a perspective view of the top and the outer ring of the closure of the present invention.
Figure 4A:
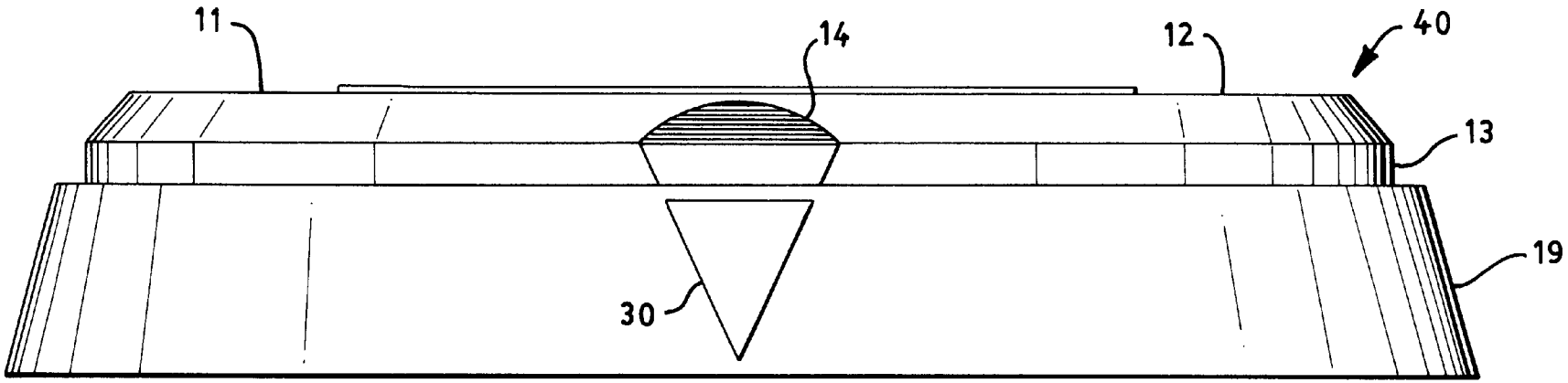
FIG. 4*a* is a front view of the top and the outer ring of the closure of the present invention.

FIG. 4 shows flip top 40 in an open position and in the absence of neck finish 22. First arrow or indicator 30 is in alignment with thumb tab 14 and retention tab 23, which projects inwardly from side wall 13. Seal 26 extends downwardly from the top wall 11 of top 12. Top 12 may be rotated through an arc by hinge 20. Outer ring locking bead 32 is shown in FIG. 4 projecting inwardly from outer ring 19 and extending along the circumference of outer ring 19. Hinge 20 is a non-tensioning hinge due to the low density of the plastic used. Hinge 20 is aligned on the side wall 13 180° away from retention tab 23. The closure flip top 40 may be made of any type of thermoplastic resin, particularly plastic material. Hinge 20 allows the top 12 to be rotated from a closed position to a fully open position. Hinge 20 also allows the top to be opened and closed repeatedly without fracturing of the hinge after repeated use. FIG. 4*a* shows the flip top 40 in the absence of the neck finish 22 and in the closed position. Cap 12 is partially elevated above ring 19.

Figure 5:
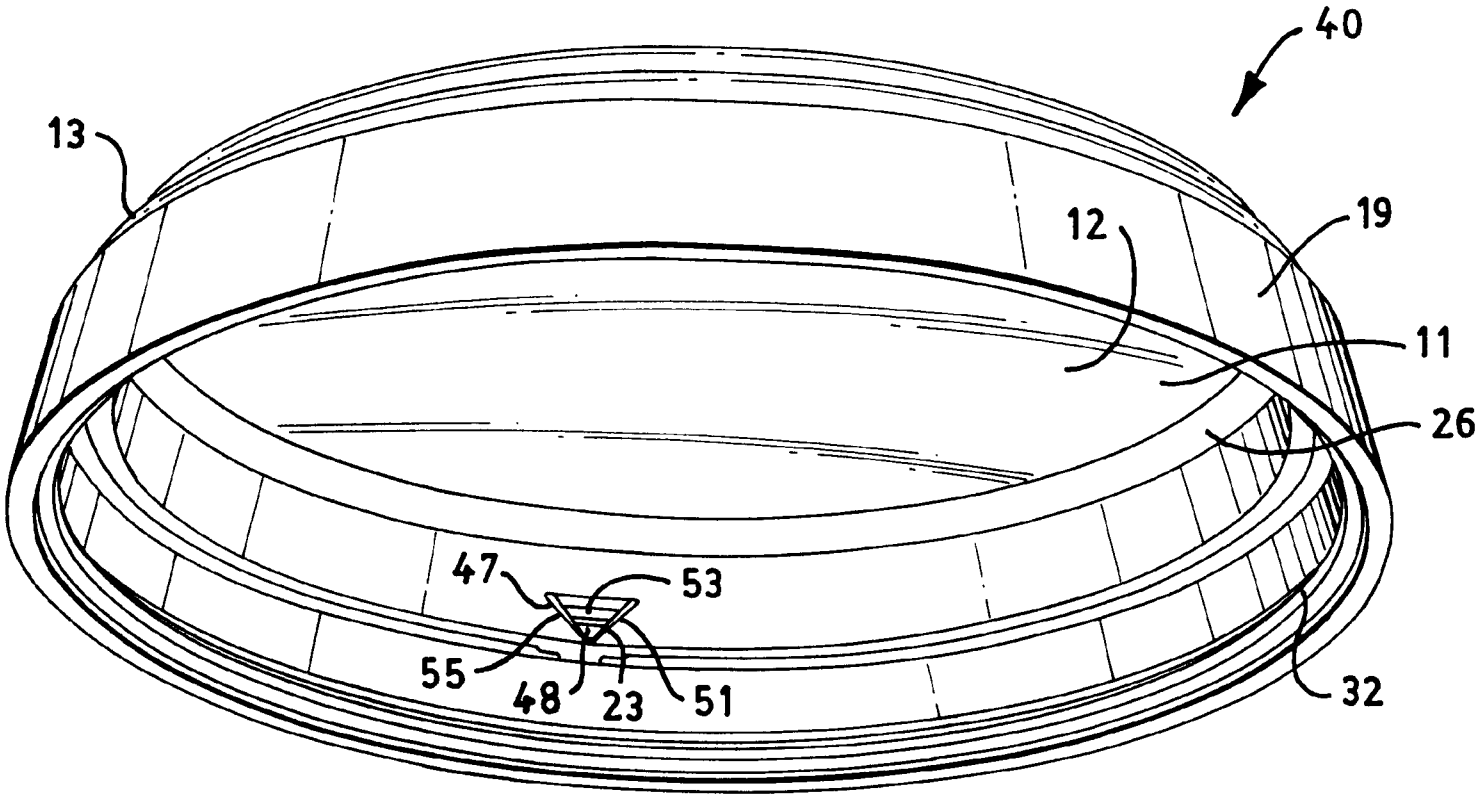
FIG. 5 is a perspective view of a top of the closure of the present invention with selected details omitted.

FIG. 5 shows top 12 in the absence of neck finish 22. Retention tab 23 includes opening follower 48 which is formed in retention tab 23 as a third sloped upper surface 53. Retention tab 23 also includes rotational follower 47 which is formed therein as at least one downwardly projecting third lower surface 51 and 55 between an edge 16 of the side wall 13 of cap 12 and said opening follower 48. When flip top 40 is attached to container finish 22, cap 12 may be removed from container finish 22 by placing flip top 40 in the firing position. When flip top 40 is in the firing position, opening cam 38 is aligned with opening follower 48. Opening cam 38 and opening follower 48 are so configured as to allow opening follower 48 to slide past opening cam 38 when upward pressure is applied to flip top 40, such as at thumb tab 14. Once opening follower 48 moves past opening cam 38, cap 12 is then removed from container finish 22 so that the contents of the container may be accessed. When the closure 10 is to be closed, downward force is applied to cap 12 so that rotational follower 47 moves past the sloped upper surface 28 of retention bead 24. Retention tab 23 may then engage the lower surface 27 of retention bead 24, thereby securing the flip top 40 in the closed position. This engagement to secure the closure in the closed position may be between opening follower 48 and retention bead 24. If, however, cap 12 is still aligned in the firing position as it is being closed, rotational cam 37 may then engage rotational follower 47, thereby biasing rotational follower 47 in either a clockwise or counterclockwise direction so as to rotate cap 12. Rotational follower 47 may then engage retention bead 24 as described. In this manner, the closure 10 is automatically removed from the firing position when it is closed. As previously indicated, rotational cam 37 and opening cam 38 may be formed independently of each other, but be so aligned as to necessitate displacement of cap 12 from the firing position as closure 10 is being closed. Likewise, rotational follower 47 and opening follower 48 may also be formed independently of each other so as to provide for the closing of the closure 10 in a non-firing position.

In use, when the embodiment of closure 10 shown in FIG. 1*a* is closed, a user may rotate flip top 40 so that retention tab 23 and retention lug 25 are aligned in the firing position. In this embodiment, the user may align first indicator 30 and second indicator 31, thereby indicating that retention tab 23 and retention lug 25 are in the firing position. The user may then apply upward force to cap 12, preferably at thumb tab 14. Third sloped upper surface 53 of retention tab 23, located on the side wall 13 of top 12, will then slide up and over first lower surface 52 of retention lug 25 located on container finish or fitment 22. The slope of first lower surface 52 is such as to allow retention tab 23 to move upward, whereas the slope of second lower surface 27 of retention bead 24 is such as to prevent upward movement of retention tab 23 when tab 23 is engaged to rib 24. The user may then access the contents of the container to which the flip top closure 10 is attached. When the user is prepared to close flip top closure 10, downward force maybe applied to cap 12, regardless of the alignment of the cap 12, since retention tab 23 may slide down over either of the two first sloped upper surfaces 50 and 54 of retention lug 25 or the second sloped upper surface of retention bead 24. In either case, retention tab 23 will eventually move under retention bead 24 so that third sloped upper surface 53 of retention tab 23 engages the second lower surface 27 of retention bead 24, thereby securing cap 12 in a closed position. If when being closed, closure 10 is aligned in the firing position wherein retention tab 23 is aligned with retention lug 25, either of third lower surfaces 51 or 55 of retention tab 23 will contact either of first upper sloped surfaces 50 or 54 of retention lug 25. First upper sloped surfaces 50 and 54 are so angled that retention tab 23 will slide to either the left or the right of retention lug 25, then contact and engage retention bead 24, thereby securely closing closure 10. In order to reopen the closure 10, the flip top 40 must again be moved into the firing position.

The foregoing detailed description is given primarily for clearness of understanding and no unnecessary limitations are to be understood therefrom for modifications will become obvious to those skilled in the art upon reading this disclosure and made without departing from the spirit of the invention or the scope of the invention.

What is claimed is:

1. A closure comprising:

a container finish including a retention bead, a rotational cam and an opening cam projecting therefrom, said rotational cam being functionally aligned with said opening cam; and, a cap being removably attached to said container finish, said cap including a hinge connecting said cap to a ring, said cap including a rotational follower and an opening follower project therefrom, said rotational follower being functionally aligned with said opening follower.

2. The closure of claim 1, said hinge being aligned 180° away from said rotational cam along a side wall of said cap.

3. The closure of claim 2, including a temporary attachment bridge connecting said ring and said side wall of said cap.

4. The closure of claim 1, said ring including a locking bead projecting therefrom.

5. The closure of claim 4, said container finish including a rib projecting therefrom.

6. The closure of claim 1, said ring including a first indicator thereon, said first indicator being aligned with said opening follower.

7. The closure of claim 6, said container finish including a second indicator thereon, said second indicator being aligned with said opening cam.

8. A closure comprising:

a container finish including a retention bead and a retention lug projecting therefrom, said retention lug including a rotational cam and an opening cam formed therein, said retention lug disposed adjacent said retention bead; and, a cap removably attached to said container finish, said cap including a hinge aligned 180° away from said retention tab along a side wall thereof said cap including a retention tab projecting therefrom, said retention tab including a rotational follower and an opening follower formed therein.

9. The closure of claim 8, said hinge being connected to a ring attached to said container finish.

10. The closure of claim 9, including a temporary attachment bridge connecting said ring and said side wall of said cap.

11. The closure of claim 9, said ring including a first indicator thereon, said first indicator being aligned with said retention tab.

12. The closure of claim 11, said container finish including a second indicator thereon, said second indicator aligned with said retention lug.

13. A child-resistant flip top closure including:

a container finish including a retention bead and a retention lug projecting therefrom, said retention lug including two first sloped upper surfaces and a first sloped lower surface, said retention bead including a second sloped upper surface and a second lower surface; and, a cap attached to said container finish, said cap attached to a hinge aligned 180° away from said retention tab along said side wall, said cap having a top wall and a side wall depending therefrom, a retention tab projecting from said side wall, said retention tab including at least one third sloped upper surface and at least one sloped third lower surface.

14. The closure of claim 13, said hinge being connected to a ring attached to said container finish.

15. The closure of claim 14, said ring including a first indicator thereon, said first indicator being aligned with said retention tab; and, said container finish including a second indicator thereon, said second indicator being aligned with said retention lug.

16. The closure of claim 15, including a temporary attachment bridge connecting said ring and said side wall of said cap.

17. A child-resistant closure comprising:

a container having a neck, said neck having a retention bead, a rib circumscribing a portion of said neck, and a retention lug projecting therefrom, said retention lug including a rotational cam and an opening cam thereon; and, a cap including a retention tab projecting therefrom, said retention tab including a rotational follower and an opening follower, a hinge connecting said cap to a ring, said ring including a locking bead projecting therefrom, said locking bead engaging said rib of said neck.

18. The child-resistant closure of claim 17, said cap including a thumb tab projecting therefrom.

19. The child-resistant closure of claim 17, said ring including a first indicator thereon and said container including a second indicator thereon.

* * * * *